United States Patent [19]

Helffer et al.

[11] Patent Number: 4,679,785

[45] Date of Patent: Jul. 14, 1987

[54] PROCESS AND INSTALLATION FOR TRANSFER AND POSITIONING

[75] Inventors: Bernard Helffer, St Andres les Vergers; Jacques Scheydecker, Avallon, both of France

[73] Assignee: Institut Textile de France, Boulogne Billancourt, France

[21] Appl. No.: 602,398

[22] Filed: Apr. 20, 1984

[30] Foreign Application Priority Data

May 4, 1983 [FR] France ..... 83 07461

[51] Int. Cl.[4] ..... B65H 7/02

[52] U.S. Cl. ..... 271/227; 271/261; 271/265

[58] Field of Search ..... 271/227, 228, 261, 265

[56] References Cited

U.S. PATENT DOCUMENTS

| | | | |
|---|---|---|---|
| 2,940,404 | 6/1960 | Damon . | |
| 3,383,107 | 5/1968 | Hedegaard . | |
| 3,640,235 | 2/1972 | Burton . | |
| 3,712,254 | 1/1973 | Beamish . | |
| 3,772,948 | 11/1973 | Burton . | |
| 4,353,539 | 10/1982 | Doyen | 271/228 X |
| 4,410,171 | 10/1983 | Kobayashi | 271/252 X |

FOREIGN PATENT DOCUMENTS

| | | |
|---|---|---|
| 20258 | 5/1980 | European Pat. Off. . |
| 56760 | 7/1982 | European Pat. Off. . |
| 701215 | 12/1940 | Fed. Rep. of Germany . |
| 2145816 | 3/1973 | Fed. Rep. of Germany . |
| 2451989 | 5/1976 | Fed. Rep. of Germany . |

*Primary Examiner*—Richard A. Schacher

*Attorney, Agent, or Firm*—Dennison, Meserole, Pollack & Scheiner

[57] ABSTRACT

Transfer and positioning apparatus including a vertically adjustable table, a workpiece introducing belt adapted to slidably move an underlying workpiece into a first location on the table. At the first location, the workpiece is engaged by fingers which depress the table to disengage the workpiece from the belt and subsequently move the workpiece across the table to a second location while changing the direction and orientation of the workpiece. At the second station, the fingers are elevated, allowing an elevation of the table and an engagement of the workpiece with a second belt which in turn slides the workpiece from the table to a second station.

14 Claims, 11 Drawing Figures

PROCESS AND INSTALLATION FOR TRANSFER AND POSITIONING

BACKGROUND OF THE INVENTION

The present invention relates to the automatic handling of workpieces, particularly in the course of a manufacturing process, when the workpieces which come from one treatment station in given direction and position must be offered to a second treatment station in predetermined direction and position which differ from the ones that they present in the first station. The invention deals more particularly with the manufacture of textile articles during which the textile workpieces, which are unitary parts of the article, pass from one station to another in order to undergo all the operations of hemming, folding, assembly, stitching . . . leading to the finished article.

French patent application No. 79 13658, corresponding to U.S. Pat. No. 4,371,159, discloses a process and an installation for taking to a second station, in predetermined fixed position and orientation, a workpiece, particularly a supple workpiece in sheet form such as a fabric, which is located in a first station in an approximate position. The fact that the workpiece is located at the first station in an approximate position requires the use of means for locating the position of the workpiece with respect to the fixed mark, with the result that the transfer means are placed on the workpiece as a function of the data transmitted by the locating means, and transfer said workpiece to the second station in the predetermined fixed position and orientation.

The major drawback of the known techniques, such as that described in the Application mentioned above, resides in the succession of independent operations which increases the time necessary for accomplishing a complete cycle.

SUMMARY OF THE INVENTION

The object of the invention is an apparatus and a process for transfer and for positioning which requires virtually no stoppage of the workpiece from the first station from which said workpiece is supplied by sliding over a flat surface by first transfer means in a given direction and a given position up to the second station where the workpiece is taken by sliding over a flat surface in predetermined direction and position which differ from those that it presents at the first station. The process according to the invention is characterized by the following steps:

a. when the workpiece reaches a first given location, it is released from the first transfer means and almost simultaneously taken over by a transfer and positioning means, these two virtually simultaneous actions being rendered possible by the sliding surface being lowered.

b. it is then transferred towards the second station by the transfes and positioning means which ensures both transfer and change of position thereof, c. when the workpiece reaches a second given location where it has predetermined position, it is released from the transfer and positioning means and simultaneously taken over by a second transfer means which transfers it to the second station in the predetermined direction and position, by the sliding surface being raised.

The course of all the steps of the process is thus virtually uninterrupted, without waste of time. The direction given at the first station is advantageously perpendicular to the predetermined direction at the second station.

This process may be carried out in a transfer and positioning installation which, according to the invention, is characterized in that it comprises:

a. a flat table over which the workpiece slides, which is mobile in height or vertically adjustable and on which two given locations are represented, b. a transfer and positioning means adapted to take over the workpiece as soon as the latter reaches the first given location, to transfer the workpiece from the first to the second given location, while modifying its position so that it has the predetermined position when it reaches said second location.

c. a second transfer means for transferring the workpiece to the second station in the predetermined direction and position, adapted to take over the workpiece as soon as the latter reaches the second given location, d. means for lowering the mobile table when the workpiece reaches the first given location, e. means for raising the mobile table when the workpiece reaches the second given location.

The workpiece is supplied from the first station by sliding over a flat surface by the displacement of the first transfer means which may be a belt; when the workpiece reaches the first given location, the mobile table whose sliding surface is in high position in line with the sliding surface of the first station, lowers, thus releasing the workpiece from contact with the first transfer means. Simultaneously to the lowering of the mobile table, the workpiece is taken over by the transfer and positioning means which transfers it by sliding over the mobile table, from the first to the second given location while giving it the determined position when it reaches said second location. Simultaneously, when the workpiece reaches the second given location, the mobile table rises and the workpiece, released from the transfer-positioning means, is taken over by the second transfer means which transfers the workpiece, by sliding over a surface which is in line with the sliding surface of the mobile table in high position, to the second station in the predetermined direction and position.

The means for lowering the mobile table when the workpiece reaches the first given location comprise a position sensor element which materializes the first given location and a bearing element which exerts on the table a pressure sufficient for the latter to pass from the high position to the low position. The high position corresponds to the one in which the workpiece is both in contact with the first transfer means of the first station and with the surface of the table; the low position corresponds to the one in which the workpiece is solely in contact with the surface of the table, and is therefor no longer driven by the first transfer means. The position sensor element controls the vertical displacement of the bearing element so that, taking into account the mechanical inertia, the workiece reaches the first given location when the bearing element has caused the table to pass from the high position to the low position.

The transfer and positioning means comprises a displacement member, which, on moving, may rotate on itself about an axis perpendicular to the plane of displacement. The displacement element is advantageously the bearing element which displaces the table in height. In this way, when the position sensor element detects the presence of the workpiece, the bearing and displacement element is applied on the workpiece as soon as the latter has reached the first given location, the pressure exerted on the workpiece places the table in low position, which releases the workpiece from the first transfer means, and simultaneously the bearing and displacement element displaces the workpiece over the table towards the second given location. During the displacement of the bearing and displacement element from the given first to the given second location, it rotates on itself about an axis perpendicular to the plane of displacement, so that the workpiece has the predetermined position when it reaches the second given location.

The means for raising the mobile table when the workpiece reaches the second given location comprise a second position sensor element which corresponds to the second given location and a counter-bearing element which causes the mobile table to return from the low position, where the bearing element held it, to the high position. The second position sensor element advantageously controls the raising of the bearing element, so that, taking into account the mechanical inertia, the workpiece reaches the second given location when, the bearing element no longer exerting its pressure on the table, the latter passes into high position. At that instant, the workpiece is then taken over by the second transfer means, which may be one or more belts having the predetermined direction; in that case the belt drives the workpiece by sliding towards the second station in the predetermined position and direction. It is generally preferable, in order to facilitate adjustments, if the belts which ensure the transfers to the first and the second station have perpendicular positions.

The invention will be more readily understood on reading the following description with reference to the accompanying drawings, in which:

DESCRIPTION OF THE PREFERRED EMBODIMENT

Figure 1:
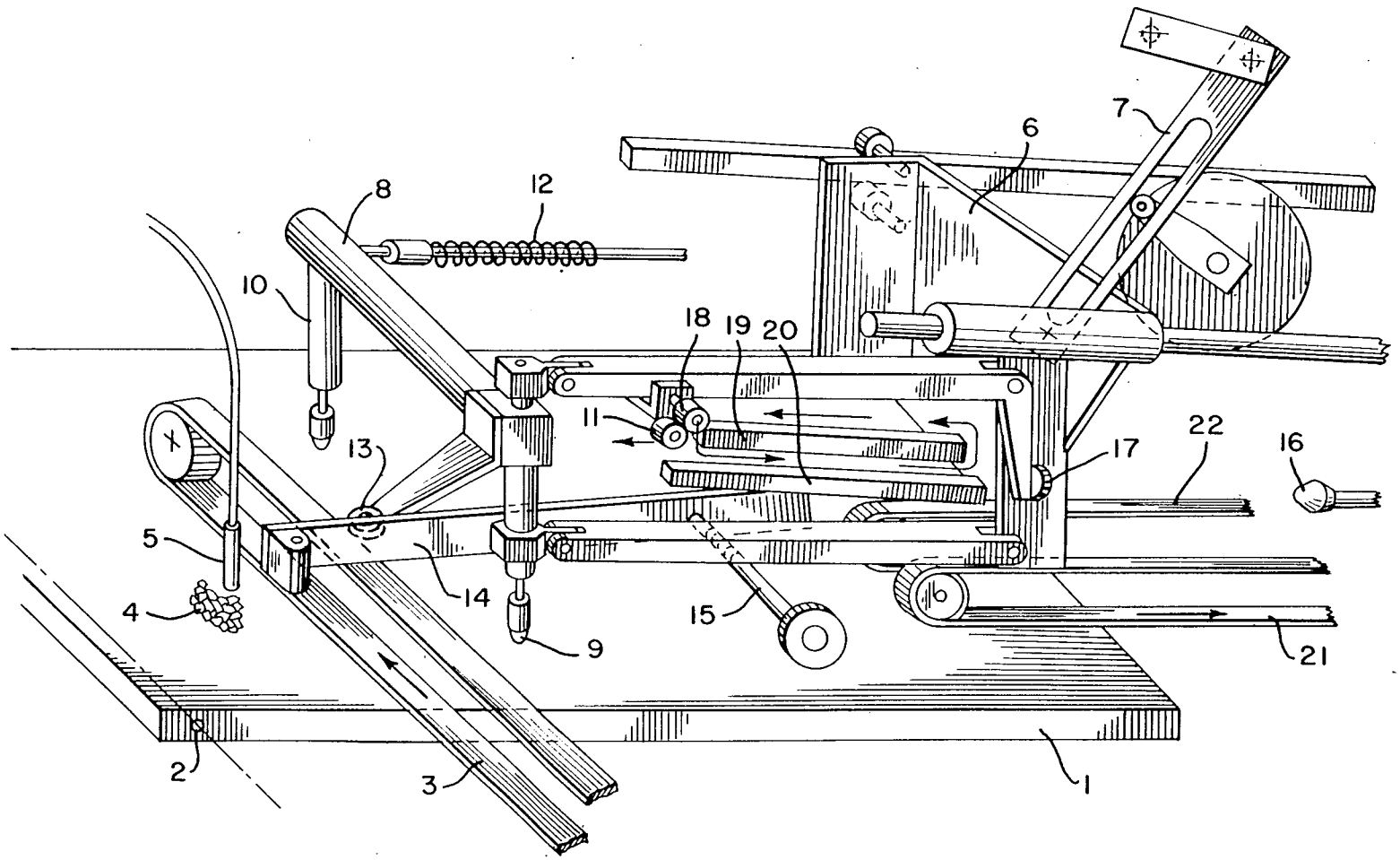
FIG. 1 is a view in perspective, and partially schematic, of a transfer and positioning installation.

Referring now to the drawings, the transfer and positioning installation comprises a table 1 vertically adjustable in height. The table as shown in FIGS. 1 and 2*a*–2*d*, may pivot about an axis 2 parallel to the direction of supply of the workpiece, or may move vertically. The surface of the table 1, when the latter is in high position, is in the same plane with, on the one hand, the sliding surface corresponding to the first station from which the workpiece comes and on the other hand to the plane corresponding to the second station towards which it is directed. Furthermore, these three surfaces are approximately contiguous, with the result that a workpiece may pass by sliding from one to the other without folds or other faults being formed. The belt 3, which conveys the workpiece from the first station, extends both over the sliding surface of said first station and over a part of the table 1. In the immediate vicinity of the location of belt 3, a window 4 made in table 1 and a lamp (not shown) are place opposite a photoelectric cell 5.

Figure 8:
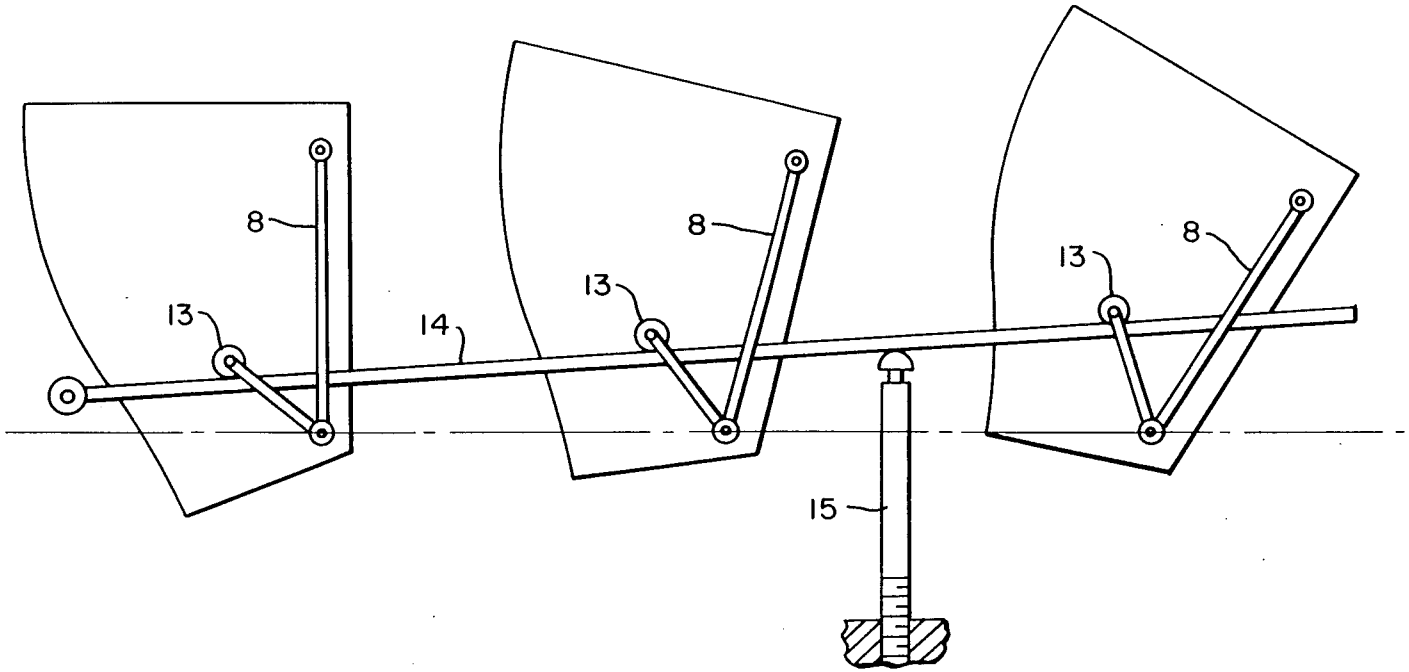
FIG. 8 schematically shows a plan view of these consecutive positions of the bearing and displacement element of the installation shown in FIG. 1.

A bearing and displacement or repositioning assembly is mounted on a carriage 6, displaceable from front to rear by a rod-crank system 7. This bearing and displaceable assembly consists of a comb element 8 which comprises two fingers 9 and 10 of which one, 9, is fixedly mounted on the carriage 6 while the other, 10, may pivot about the vertical axis constituted by the finger 9. The comb element 8 moves downwardly upon the opening of a retention element or follower 11 as shall be explained subsequently, such opening being controlled by the photoelectric cell 5 when it detects the presence of the workpiece on the table 1 level with window 4. The comb element 8 moves laterally in response to the displacement of the carriage itself. During the lateral displacement of the comb element 8, the finger 10 pivots through a certain angle about finger 9 as noted in FIG. 8, such pivoting is obtained by the combined action of the compression spring 12 which tends to repel the finger 10, and of the roller 13 which limits this pivoting, the roller 13 being fast with the comb element 8 and abutting on a ramp 14. The angle of this ramp 14 with respect to the predetermined direction of movement of carriage 6 is adjustable by means of screw 15, the ramp 14 being returned against this screw by a spring (not shown). At the end of stroke of the carriage 6, a stop 16 causes the comb 8 to rise by abutting on the lever 17, fast with the comb element 8. The complete cycle of displacement of the comb element 8, noting FIGS. 4–7, therefore comprises four continuous phases: lowering, lateral displacement, for example from left to right in FIG. 1, raising, displacement from right to left. Correct functioning of this cycle is effected by a guide assembly of which one part, constituted by a caster 18, is mounted on the lower lever 17 and therefore the carriage 6 and of which the other part, constituted by two bars 19 and 20, is fixed with respect to carriage 6. Bar 19 parallel to bar 20 is mounted above the latter. One of its ends is located opposite the follower 11, while the other end overhangs the corresponding end of the bar 20. The belts 21 and 22, which have the predetermined direction, perpendicular to that of the belt 3, and which ensure the transfer of the workpiece towards the second station, extend both over the sliding surface of said second station and over a part of table 1.

Figure 2A:
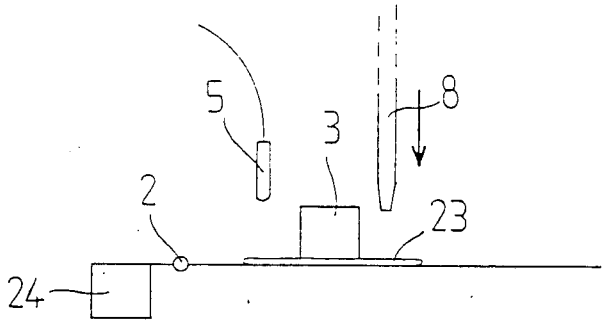
FIGS. 2*a*, 2*b*, 2*c* and 2*d* schematically show the diferrent stages of operation of the installation.
Figure 2B:
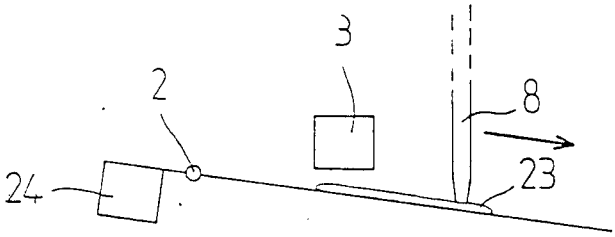
Figure 2C:
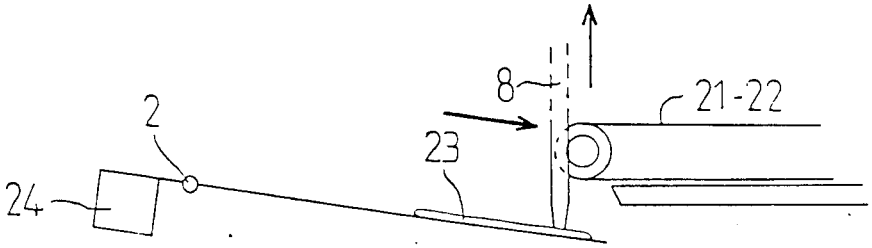
Figure 2D:
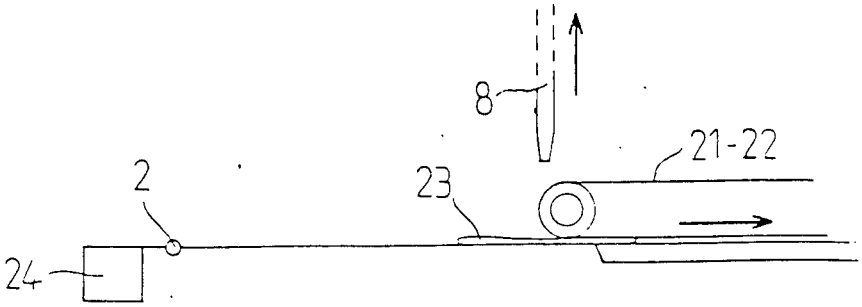

The transfer and positioning installation operates as follows. The workpiece 23 is conveyed by belt 3 by sliding over the horizontal sliding surface to the first station then partially over the table 1 (FIG. 2*a*). When it passes level with window 4, the interruption of the illumination of the lamp located beneath this window is detected by the photoelectric cell 5 which controls opening of the follower 11. The caster 18 which was maintained between the follower 11 and the bar 19 is released, and allows the comb element 8 to be lowered until the caster 18 encounters the bar 20. The comb element 8, on lowering, abuts on the workpiece 23 with the aid of fingers 9 and 10, and exerts a pressure on table 1 which pivots about axis 2 (FIG. 2*b*). During the displacement of carriage 6 from left to right under the effect of the rod-crank system 7, the comb element 8 takes along the workpiece 23 which slides over the inclined surface of table 1 (FIG. 2*c*). The inclination of table 1 is identical to that of bars 19 and 20 with respect to the horizontal, since it is the displacement of caster 18 along the rod 20 which guides the displacement of the comb element 8. During the saem displacement of the carriage 6, noting FIG. 8, the roller 13 fast with the comb element 8 follows the direction of the ramp 14 against which it abuts under the effect of the compression spring 12. In this way, during this lateral displacement, the finger 10, which follows the movement of the roller 13, pivots about the vertical axis formed by finger 9. This relative movement of the two fingers 9 and 10 one with respect to the other makes it possible to give the workpiece 23 the desired position. As a function of the workpiece to be treated on the installation, the angle through which the workpiece will pivot about the fixed finger 9, during the left to right lateral displacement, may be adjusted by modifying the angle formed by the ramp 14 with respect to the direction of transfer of the carriage, by acting on the adjusting screw 15. At the end of this lateral displacement, the stop 16 abuts on the lever 17 fast with carriage 6. On pivoting, the lever 17 raises both the caster 18 and the comb element 8. Once raised, the comb element 8 no longer exerts any pressure on the table 1, and the latter returns to its high position under the effect of the counterweight 24. The workpiece 23 comes into contact with the belts 21 and 22 which have the determined direction, and is taken along thereby in the determined position and direction by sliding firstly over a part of table 1 then over the sliding surface of the second station (FIG. 2*d*). During this time, the rod-crank system continues to drive the carriage 6. The caster 18, raised under the action of lever 17, is passed over rod 19 and guides the comb element 8 in its right to left displacement towards the initial position. A fresh workpiece 23 is supplied from the first station, and the cycle resumes.

Figure 3:
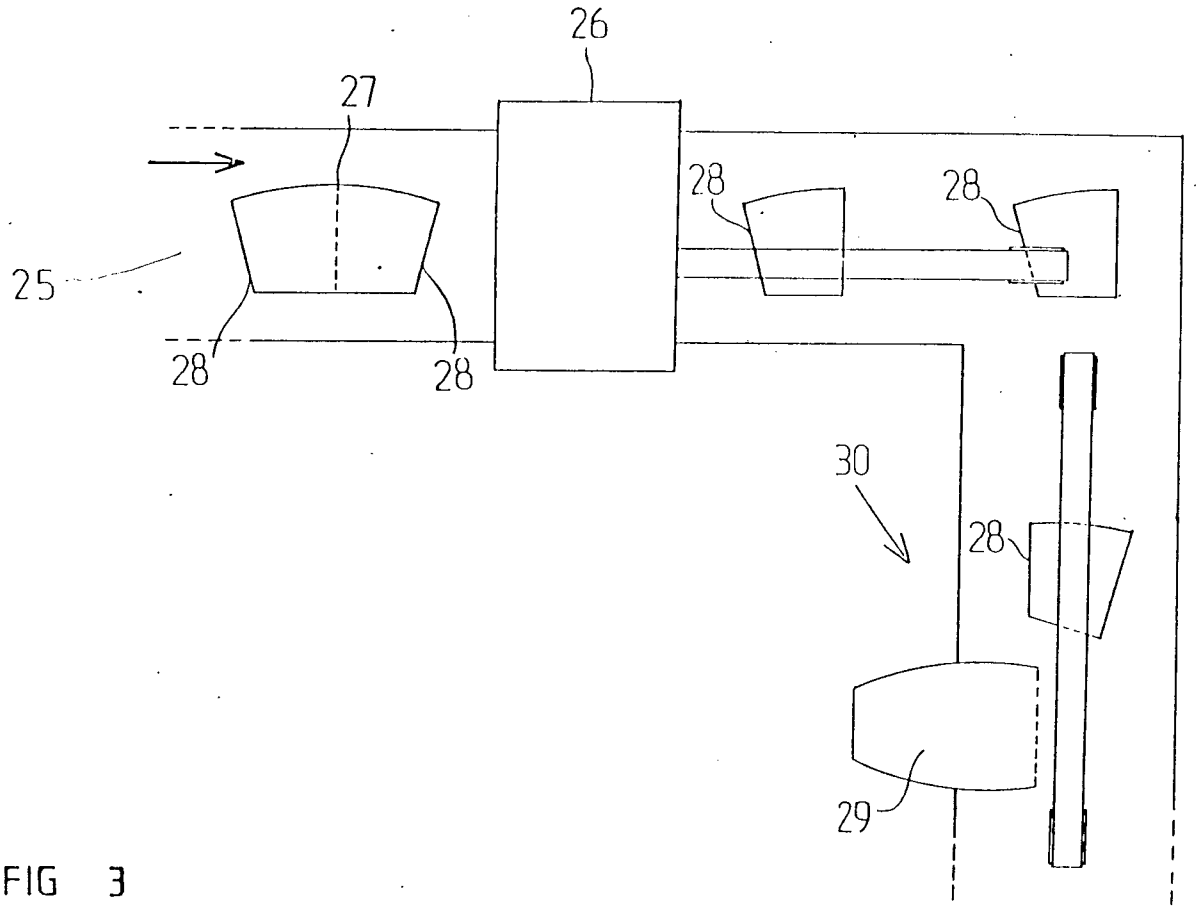
FIG. 3 shows an example of the application of the process to the closure of sleeves.
Figure 4:
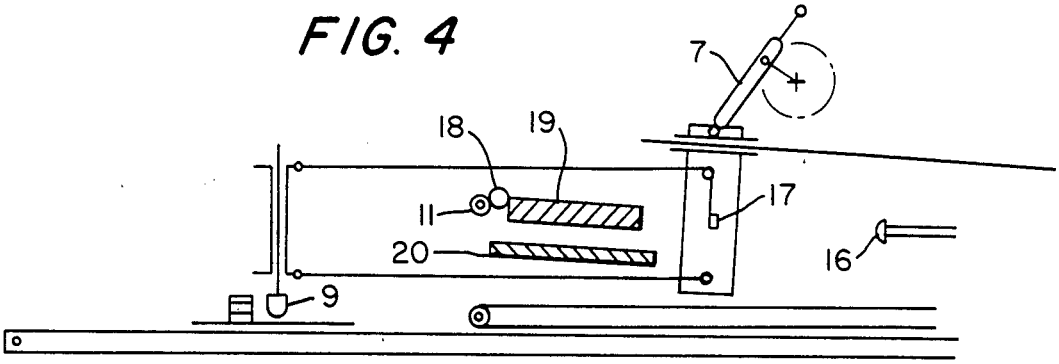
FIGS. 4–7 schematically show four stages of the cycle of operation of the installation of FIG. 1, viewed from the side.
Figure 5:
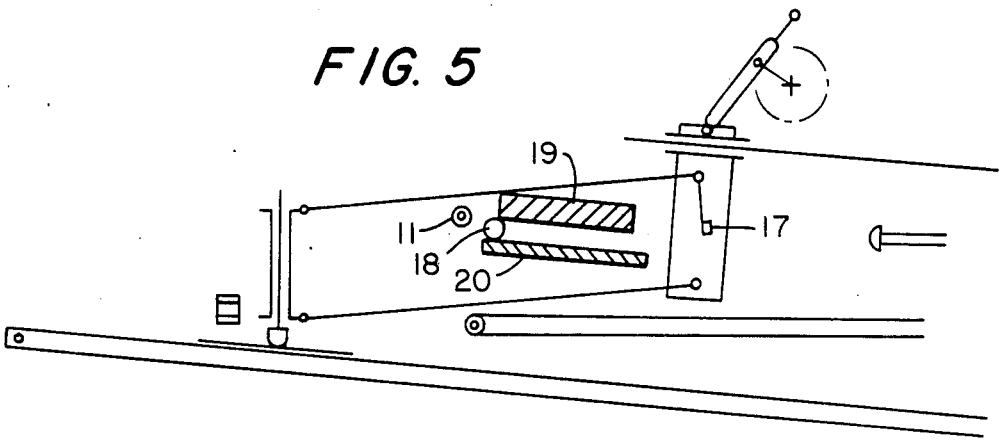
Figure 6:
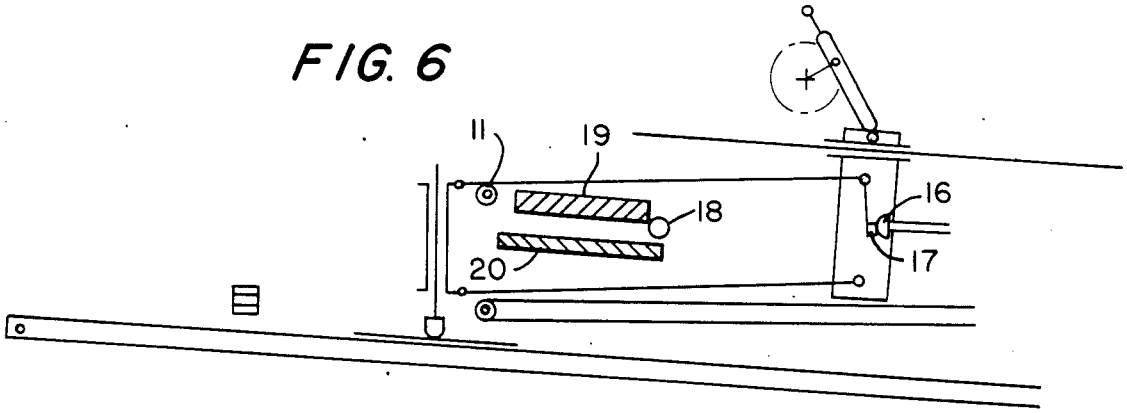
Figure 7:
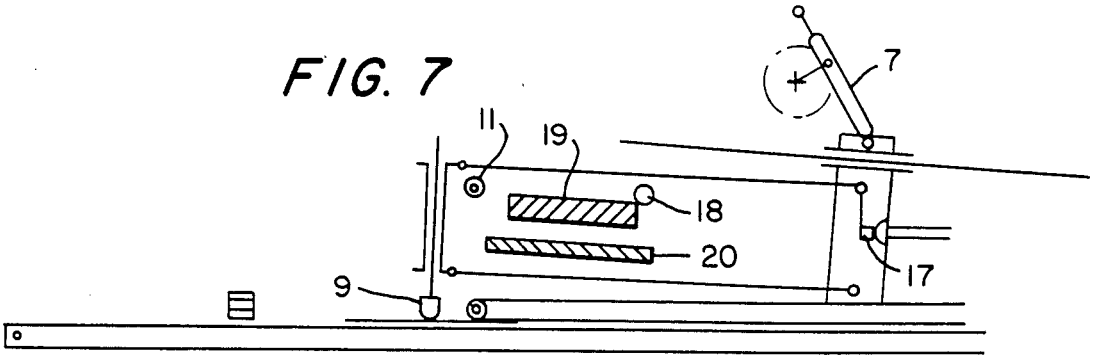

The process and installation according to the invention are particularly adapted to the closure of short sleeves such as tee-shirt sleeves, as shown in FIG. 3. In that case, the workpiece 23 is a sleeve coming from a finishing station having effected for example hemming or cording of the sleeve bottom 25, then folding 26 of the sleeve along an axis of symmetry 27 so that there is exact overlapping of the two parts of the sleeve on the other. Once folded, the workpiece 23 must be closed; this closure is effected by stitching the two edges 28, matched and superposed. Taking into account the shape of the sleeve 23, it is then necessary to guide the line of stitching 28 under the sewing machine 29 in a direction and position which are different from those that it had on leaving folding 26. As shown in FIG. 3, it is necessary to both transfer the sleeve 23 from the folding station to the stitching station 30 and to subject it to a partial rotation on itself, so as to place the line of stitching 28 exactly in position and in direction under the sewing machine.

Of course, the installation according to the invention comprises all the adjustments necessary for changing workpieces and position, particularly adjustment of the ramp 14 by the screw 15 but also adjustment of the or each finger 9, 10 as a function of the size of the workpieces, adjustment of the control time of the opto-electronic sensor as a function of the choice of the first location, and adjustment of the stop 16 and of the stroke of the rod-crank 7 as a function of the desired length of lateral displacement.

We claim:

1. A system for the transferring and positioning of a workpiece upon movement thereof from a first station to a second station, said system comprising a vertically adjustable surface having first and second locations thereon, first transfer means for slidably introducing a workpiece onto said surface at said first location, repositioning means overlying said surface for selective engagement with a workpiece at said first location and a transfer and repositioning of the workpiece to the second location, and second transfer means for engaging said workpiece at said second location and slidably removing the workpiece from said surface toward the second station, said repositioning means including vertically adjustable elements, means responsive to the presence of a workpiece at the first surface location for effecting a downward movement of said elements against the workpiece and the underlying surface, support means for said surface responsive to engagement of said elements against a workpiece and underlying surface to allow a vertical downward movement of said surface and a downward retraction thereof from the first transfer means, means for laterally shifting said elements, means for rotating said elements during a lateral shifting thereof, and means, at the second surface location, for retracting said elements, allowing a vertically upward return of said surface and an engagement of a repositioned workpiece with said second transfer means remote from said first location and said first transfer means.

2. An installation for transferring and positioning a workpiece, by sliding over a flat surface, from a first station in a given direction and a given position, to a second station in a predetermined direction and position which differ from those that it presents at the first station, wherein the installation comprises:

a flat table over which the workpiece slides, said table being vertically adjustable and having first and second given locations represented thereon, first transfer means for introducing a workpiece to said first given location in an initial direction and a predetermined position, combined transfer and positioning means for engaging the workpiece at the first given location, and transferring the workpiece from the first to the second given location, whilst modifying its position so that it has predetermined position when it reaches said second location differing from that of the workpiece at the first location, second transfer means for transferring the workpiece in a predetermined direction and position from the second given location to the second station, means for lowering the table when the workpiece reaches the first given location, and means for raising the table when the workpiece reaches the second given location.

3. The installation of claim 2, including pivot means mounting the table for pivotal adjustment about an axis parallel to the initial direction of the workpiece at the first station, and table adjustment means for adjusting said table between a high position where its surface is at a level corresponding to that of the first and second stations, and a low position where its surface is below the level of the stations.

4. The installation of claim 3, wherein the table adjustment means includes first adjustment means for lowering the table comprising a first position sensor element, a bearing element, and means responsive to said first sensor element to extend said bearing element and exert pressure on the table sufficient to move the table from the high position to the low position.

5. The installation of claim 4, wherein the first position sensor element comprises an opto-electronic assembly located in the immediate vicinity of the first given location, which controls the responsive movement of the bearing element when it detects the presence of the workpiece which activates the assembly by interruption of a light beam.

6. The installation of claim 4, wherein the combined transfer and positioning means comprises a comb element selectively engageable with said workpiece, said combined transfer and positioning means, and said comb, being displaceable laterally and vertically, and means adapted to pivot said comb element and cause the workpiece to rotate therewith during its lateral displacement through an angle corresponding to the desired change in position.

7. The installation of claim 4, wherein said combined transfer and positioning means includes a rod-crank system engaging said comb element for lateral displacement of the comb element.

8. The installation of claim 6, wherein the comb element comprises two fingers, one mobile, the other fixed, the means adapted to pivot the comb element comprising a compression spring engaging said comb element and biasing said comb element to rotate the mobile finger about the fixed finger, a roller fast with the comb element and a ramp engaged by said roller for travel of said roller therealong, said ramp forming, with the predetermined direction of transfer to the second station, an angle equal to that corresponding to the desired change in position, whereby, when the comb element moves laterally, the roller follows the direction of the ramp and causes the mobile finger to pivot about the fixed finger through the desired angle.

9. The installation of claim 6, wherein the table adjustment means includes second adjustment means for raising the table comprising a second position sensor element, and a counter-bearing element pivotally fixed, at an intermediate point along the length thereof, to said combined transfer and positioning means.

10. The installation of claim 9, wherein the second position sensor element is a fixed stop which acts, at the end of the lateral displacement of the combined transfer and positioning means, on the counter-bearing element, said counter-bearing element comprising a lever having a first end engageable with said fixed stop and a second end pivotally mounted to said bearing element for pivotally retracting said bearing element whereby the table is released and may be raised.

11. The installation of claim 9, including a caster fast with the comb element, said first adjustment means including a retention element controlled by the first position sensor element, and a bar, said retention element selectively cooperating with said bar to underlie said caster and preclude downward movement of said caster and said comb therewith, and means for selectively moving said retention element to allow downward movement of said caster and comb therewith, and lever means fast with the comb element, said lever means being responsive to and controlled by the second position sensor element for selectively raising said caster and said comb element therewith upon a predetermined lateral displacement of said comb element corresponding to movement of the workpiece to the second given location.

12. The installation of claim 4, wherein the transfer and positioning means includes said bearing element.

13. The installation of claim 2, wherein the first and second transfer means for transferring the workpiece to the first station and to the second station are belts which drive said workpiece by sliding.

14. The installation of claim 13, wherein the belts for driving the workpiece to the first station and to the second station extend in perpendicular directions to each other.

* * * * *

UNITED STATES PATENT AND TRADEMARK OFFICE

CERTIFICATE OF CORRECTION

PATENT NO. : 4,679,785

DATED : July 14, 1987

INVENTOR(S) : Bernard Helffer et al

It is certified that error appears in the above-identified patent and that said Letters Patent are hereby corrected as shown below:

Claim 7 should depend from claim 6, not claim 4.

Signed and Sealed this

Sixth Day of October, 1987

*Attest:*

*Attesting Officer*

DONALD J. QUIGG

*Commissioner of Patents and Trademarks*